United States Patent [19]

Roland

[11] 3,937,465

[45] Feb. 10, 1976

[54] TENNIS STROKE TRAINING DEVICE

[75] Inventor: Bruce Roland, San Pedro, Calif.

[73] Assignee: Rolson & Co., Rancho Palos Verdes, Calif.

[22] Filed: Sept. 13, 1974

[21] Appl. No.: 505,558

[52] U.S. Cl. ..... 273/29 A; 273/188 R

[51] Int. Cl.[2] ..... A63B 61/00

[58] Field of Search .... 273/29 A, 26 R, 26 C, 35 R, 273/190 B, 183 B, 191 R, 191 B, 67 C, 73 R, 73 J, 75, 81, 162 R, 188 R, 189 R, 189 A, 54 B, 192, 194 R, 194 A, 193 A

[56] References Cited

UNITED STATES PATENTS

| | | | |
|---|---|---|---|
| 3,101,196 | 8/1963 | Ferrara | 273/54 B |
| 3,595,583 | 7/1971 | Oppenheimer | 273/73 R |
| 3,740,052 | 6/1973 | Arkin | 273/190 B |

FOREIGN PATENTS OR APPLICATIONS

| | | | |
|---|---|---|---|
| 205,442 | 10/1923 | United Kingdom | 273/75 |
| 16,681 | 7/1903 | United Kingdom | 273/75 |
| 522,814 | 6/1940 | United Kingdom | 273/191 R |

*Primary Examiner*—Richard C. Pinkham
*Assistant Examiner*—T. Brown
*Attorney, Agent, or Firm*—Robert J. Schaap

[57] ABSTRACT

A training device for assisting a trainee in stroking a tennis racquet in such manner that the head of the tennis racquet does not shift in a vertical plane below the wrist of the trainee and, as such, always remains above the wrist of the trainee in such vertical plane. This training device comprises a harness which is secured to the body of the trainee and a cord which extends from the harness to the racquet. The opposite end of this cord is removably attached to the racquet at a point which is intermediate the head portion and the handle of the racquet. In this way, the trainee will always maintain his wrist below the head of the racquet and, in addition, the cord is adjustably sized so that it may be used to limit the forward and backward swing of the racquet in any stroking thereof by the trainee.

11 Claims, 3 Drawing Figures

TENNIS STROKE TRAINING DEVICE

BACKGROUND OF THE INVENTION

This invention relates in general to certain new and useful improvements in game training devices, and, more particularly, to tennis game training devices of the type which are adapted to maintain proper stroking of a tennis racquet by means of a device which is adapted to be worn by the player and which is also adapted to be secured to a tennis racquet.

It is well known that proper form and control of a tennis racquet in any game of tennis is primarily dependent upon the stroking of the tennis racquet by the player. Moreover, in the normal game of tennis, certain parameters are critical in order to achieve proper control in operation of the tennis racquet. First of all, it has been established that it is necessary for the tennis player to maintain the head of the tennis racquet at least parallel to or above the player's wrist during all stroking movements of the tennis racquet. Secondly, it has been established that it is necessary for the tennis player to turn away from the net in order to move the tennis racquet to a proper position to engage the tennis ball. Thirdly, it is important for the tennis player to maintain the correct distance between the arm of the player and the body portion in order to achieve this proper stroking. Fourthly, it has also been established that it is necessary to limit the backward and forward movement of the tennis racquet in any stroking operation.

Due to the fact that the game of tennis has become a very popular sport and recreational pastime, there have been many technical articles and books written by professionals, or the so-called "alleged professionals," with regard to improvement in the game of tennis. However, these articles and books are effective only to the extent that they teach the tennis player, in literary form, with respect to proper movement of a tennis racquet. Nevertheless, each of these literary articles suffers from the very substantial disadvantage that they do not aid the tennis player once this player or trainee is actually engaged in a game of tennis or in a training exercise on a tennis court.

One of the principal problems involved in the training of the tennis game trainee is that a tennis game trainee may have read such literary articles and, in fact, may have been instructed by a trainer, although the instruction obtained from the trainer or these articles is of limited value when the trainee attempts to actually practice the techniques which are taught. One of the primary problems involved is that the stroking of the tennis racquet in proper game form deviates from normal body movement. Moreover, the trainee in the game of tennis finds great difficulty in achieving the necessary stroking movement which would aid in the ability to play the game of tennis by such trainee.

The present invention obviates these and other problems in the provision of a tennis game training device which assists a trainee in proper stroking of a tennis racquet. Normally, the tennis racquet will include a head portion capable of engaging a tennis ball and a handle portion which is secured to this head portion and is capable of being grasped by the trainee. Moreover, this tennis game training device will include a harness which is adapted to be worn by the trainee and a cord extends from the harness for removable attachment to the racquet. The cord is adjustably sized of a length sufficient to permit the player or trainee to stroke the tennis racquet with relatively free arm and body movement, but which nevertheless prevents the wrist of the trainee from being located in a vertical plane above the head of the tennis racquet when stroking the same.

It is, therefore, the primary object of the present invention to provide a game training device which assists a trainee in stroking a racquet of the type which engages a playing ball, in order to achieve optimum stroking movement thereof.

It is also an object of the present invention to provide a game training device of the type stated which comprises a harness adapted to be worn by the trainee as well as a cord which extends from the harness and is removably secured to the tennis racquet in order to obtain limited but yet sufficient movement of the tennis racquet during a stroking operation by the trainee thereof.

It is a further object of the present invention to provide a game training device of the type stated which is capable of effectively aiding in the limiting of the forward and backward swing of a tennis racquet in any stroking thereof by the player.

It is another object of the present invention to provide a game training device of the type stated in which the cord thereof is utilized to aid the trainee in maintaining his arm at a correct distance from the body.

It is another salient object of the present invention to provide a tennis training device of the type stated which is durable in its construction, capable of being manufactured at a relatively unit cost, and which is highly reliable in its operation.

With the above and other objects in view, my invention resides in the novel features of form, construction, arrangement, and combination of parts presently described and pointed out in the claims.

GENERAL DESCRIPTION

Generally speaking, the present invention resides in a game training device which assists a trainee in learning correct stroking of a tennis racquet for the game of tennis. In this case, the device of the present invention comprises a harness which is adapted to fit around the body of the trainee and includes a cord having a clamp at its outer end. The clamp is adapted to be attached removably to the tennis racquet, either at the throat portion which connects the handle of the tennis racquet to the head rim or otherwise to the head rim itself.

The harness includes a second loop which is designed to extend around the neck portion of the trainee and a first loop which is designed to extend around the shoulder portion of the trainee. Each of these loops is adjustable so as to conform to the size of the trainee. Moreover, the cord is similarly adjustable so that it can be either shortened or lengthened in such manner that the tennis racquet can be held and stroked in the desired position. When the cord is maintained at sufficient length, the wrist of the trainee is always held at a position either parallel to or below the head of the tennis racquet in order to conform to desired tennis stroking requirements. Moreover, this device also requires the trainee to turn the torso of the body sufficiently inasmuch as the forward and backward swing is somewhat limited, due to the device of the present invention.

The cord which connects the harness to the tennis racquet is formed of a material which is somewhat resilient but which is yet fairly inextensible. In addition, the cord aids the trainee in maintaining his arm at a correct distance from the torso of the body.

The present invention may also be described as a method for assisting a trainee in stroking a tennis racquet. The method comprises the attaching of a harness to the trainee with a cord connected to the harness. The free end of the cord is attached to the tennis racquet. The length of the cord is then adjusted between the harness and racquet so that the wrist of the trainee is always parallel to or below the head of the racquet when the trainee strokes the racquet.

BRIEF DESCRIPTION OF THE DRAWINGS

Figure 1:
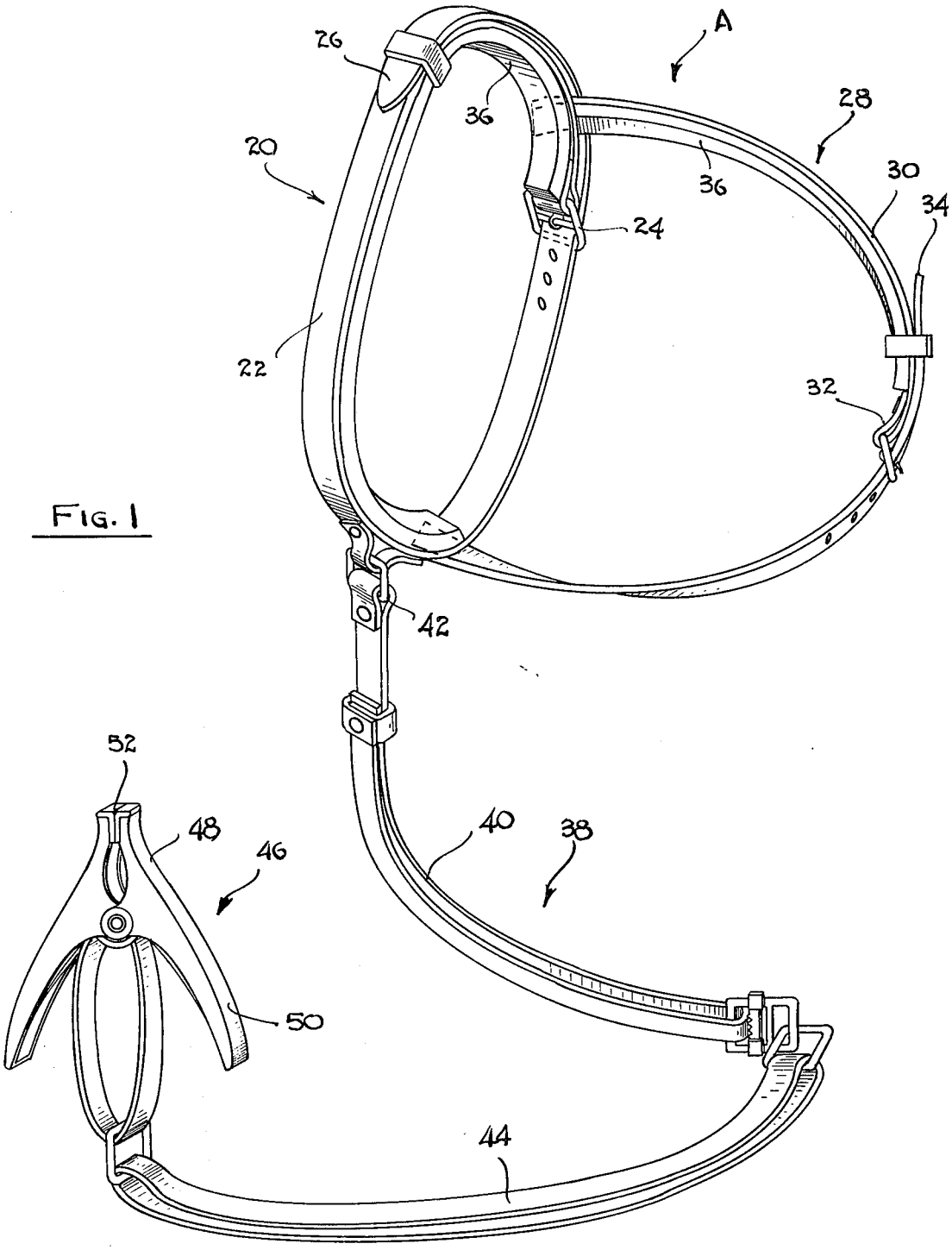
Figure 2:
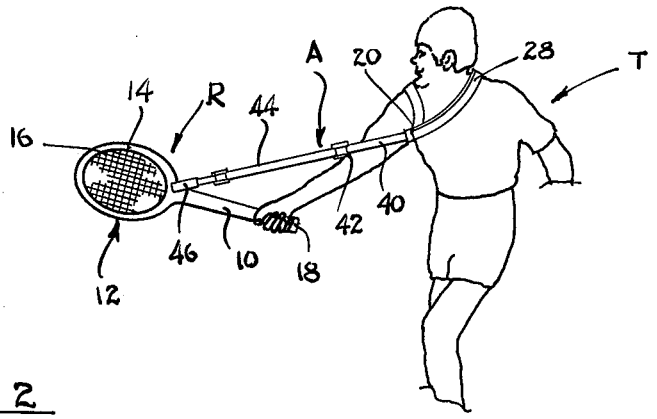
Figure 3:
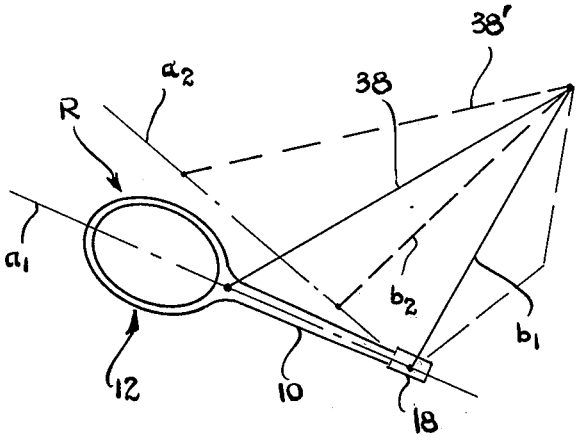

Having thus described the invention in general terms, and the objects achievable thereby, reference will now be made to the accompanying drawings in which:

FIG. 1 is a perspective view of a game training device constructed in accordance with and embodying the present invention;

FIG. 2 is a schematic view showing a tennis player or tennis game trainee utilizing the apparatus of the present invention; and FIG. 3 is a vector diagram showing the operation of the device of the present invention.

DETAILED DESCRIPTION

Referring now in more detail and by reference characters to the drawings which illustrate a preferred emobdiment of the present invention, A designates a tennis game training device which may be utilized with a player or so-called "trainee" T. In each case, the trainee T will utilize the device A in connection with a conventional tennis racquet R comprising an elongated handle 10 which integrally merges into a head portion 12. Moreover, this head portion 12 is provided with an annular rim 14 supporting a quadrilaterally located arrangement of strands forming a net 16, and which is designed to engage a tennis ball (not shown). In addition, the tennis racquet 12 will be provided with a grip portion or so-called "grip" 18 on the outer end of the handle 10 which is adapted to be grasped by the player. In this case, the grip could adopt a variety of forms, and usually is formed of a tape or a similar substance wrapped around the surface of the handle which provides a non-slip surface.

The apparatus A of the present invention generally comprises a harness including a first loop 20 which is adapted to extend around the arm of the trainee and to be located over the shoulder portion thereof. The loop 20 is formed by a relatively cylindrical strap 22 which is provided with a size adjustment means in the form of a buckle 24 and an opposed terminal end 26. The terminal end 26 is adapted to be received by the buckle 24 in order to adjust the size of the loop 20 to the proper overall circumferential length. In this way, the loop 20 can be sized to fit around the shoulder portion of the trainee.

Riveted, or otherwise rigidly secured, to the loop 20 is a second loop 28 which is similarly formed of a belt or strap 30 which is somewhat semi-cylindrical in nature and is designed to extend around the neck of the trainee. In like manner, this loop 28 is provided with second adjustment means in the form of a buckle 32 and an opposed terminal end 34. Moreover, the terminal end 32 is designed to be connected to the buckle 30 in any of a plurality of positions in order to provide the proper overall size of the loop 28. Consequently, it can be observed that the harness A can be worn by a wide variety of people.

The straps 22 and 30 may be formed of any suitable material such as leather, or various other synthetic resin materials, e.g. vinyl plastics normally used in the manufacture of leather and synthetic leather goods. In each case, in order to aid the comfort of the wearer or trainee, each of the loops 22 and 28 are porvided on their interior surface with felt paddings, or similar type of resilient padding, 36 which aids in the comfort of the wearer of the harness A. However, it should be recognized that any form of flexible or resilient padding material could be used. Moreover, any means for adjusting the size of the various loops 20 and 28 could also be utilized in place of the buckles heretofore described.

Extending outwardly from the harness, in the manner as illustrated in FIGS. 1 and 2 of the drawings, is a connecting cord 38 and which includes a relatively inextensible strap 40 formed of leather, or other form of synthetic resin material of the type described above. Thus, the strap 40 is similar in construction to and uses the same materials used in the construction of the loops 20 and 28 of the harness. The strap 40 is secured to the harness through a buckle 42 which is adjustably sized in order to conform to the size and the ability of the wearer or trainee. In this respect it should be recognized that the buckle 42 could be located anywhere along the length of the strap 40.

Secured to the outer end of the strap 40 is a somewhat elastic loop 44 which, in turn, carries a removably actuated clamp 46. Generally, the elastic loop 44 provides just the desired amount of flexibility so that the device does not introduce difficulty in swinging or otherwise maneuvering the racquet. In other words, the loop 44, which is fairly non-elastic, is still sufficiently elastic to allow additional movement if the stroke so requires.

The clamp 46 is preferably of the type which includes a pair of fingers 48 which are spring-biased to engage an object, such as a tennis racquet handle 10 or the head frame 14. Moreover, the clamp 46 includes a pair of opposed arms 50 which may be squeezed together in order to release the fingers 48 from the engaging position. Moreover, the fingers 48 are provided with foam-like pads 52 on the interior surfaces thereof in order to prevent any abrasion or scratching of the tennis racquet R.

The training device of the present invention is highly unique in that it enables a trainee to swing a tennis racquet R in a desired movement with respect to the body of the trainee. In this respect, it can be observed that the harness is fitted upon the body in such manner that the loop 28 extends around the neck portion of the trainee, and the loop 20 extends around the shoulder portion of the trainee. Again, each of these loops 20 and 28 are adjustably positioned by means of the buckles 24 and 32 in order to conform to the size of the trainee. Moreover, the length of the connecting strap 40 is also adjustable so as to properly position the tennis racquet.

When the trainee engages the handle 10 of the tennis racquet R, it can be observed that the cord 38 limits the downward movement of the head 12. In this way, it can be observed that the trainee must always position the head 14 either parallel to or above his wrist, since the cord 38 restrains lower movement of the head 12. A somewhat schematic vector diagram showing the use and operation of the apparatus A is more fully illustrated in FIG. 3, and in which case, the arm of the trainee T, the cord 38 and the handle 10 form the three sides of a triangle. It can be observed that in this case, the downward movement of the head 12 is limited by the cord 38.

Thus, by further reference to FIG. 3, it can be observed that an axis $a_1$, passing longitudinally through the tennis racquet handle 10, represents a first position of the racquet R. In this case, the grip 18 is below the head 12. The handle can be shifted so that it adopts a position designated by the axis $a_2$. In this case, the cord 38 shifts outwardly to the position designated as 38'. Moreover, the arm of the trainee will shift from a position designated as $b_1$ to $b_2$ in the manner as illustrated in FIG. 2. In any event, the cord 38 prevents the racquet R from being shifted to a position where the head 12 is located below the wrist of the trainee.

The device of the present invention is also highly effective in limiting the forward and backward swing of the tennis racquet R, since it effectively restrains the movements in each direction. Again, this is highly desirable in that it prevents the trainee from overswinging in both the forward and backward direction. Moreover, because of the fact that the device A restrains movement in this manner, it forces the trainee to turn sufficiently in order to swing the racquet R to a position where it is capable of engaging a tennis ball. In addition, when the trainee learns to keep the cord 38 in a fairly taut condition, he simultaneously learns to hold the tennis racquet R at a correct distance in such manner so that the arm is located at a correct distance from the torso of the body.

In this respect, the length of the cord can be adjusted in order to permit the practicing of any particular stroke. Thus, for example, the device of the present invention is primarily useful in practicing either forehand stroking, backhand stroking or valley stroking. Generally, the angle between the forearm and the handle of the tennis racquet will vary depending on the type of stroking. For a typical forearm stroke, the angle may be as great as 180°, whereas for typical volley stroking, the angle may be in the range of 90° and the typical backhand stroking would provide for a desired angle between these two limits. The user of the device will merely establish the proper length of the cord for the particular type of stroke being practiced. In many cases the training professional or trainor will usually determine the proper length of the cord for the trainee to practice such selected strokes.

The device of the present invention is also highly effective in preventing the trainee from reaching out for the tennis ball or otherwise prematurely starting the stroke. Thus, due to the fact that the cord somewhat limits the possible movement of the arm of the trainee, the trainee is constrained to wait for the proper arrival of the tennis ball and, in addition, forces the trainee to turn the torso side of the body toward the net in order to more fully face the tennis ball.

Notwithstanding any of the above, it can be observed that the device A does not physically restrain the movement of the trainee so that the trainee is still capable of moving sufficiently in order to manipulate the various portions of the body in conformity with desired tennis game form.

Thus, there has been illustrated and described a novel tennis game training device which restrains the tennis player in omvement of a tennis racquet in such manner that proper form is maintained and which therefore fulfills all of the objects and advantages sought therefor. It should be recognized that many changes and modifications can be made in the form, construction, arrangement and combination of parts without departing from the nature and principle of the invention. Therefore, all such changes and modifications, as well as various other uses and applications of the subject device can be made without departing from the nature and principle of the invention. Therefore, all such changes and modifications and other uses and applications are deemed to be covered by the invention which is limited only by the following claims.

Having thus described my invention, what I desire to claim and secure by letters patent is:

1. A tennis training device for assisting a trainee in stroking a tennis racquet having a head capable of engaging a ball and a handle capable of being grasped by a trainee; said training device comprising: a harness for securement to the body of a trainee, said harness comprising only first and second body loops, said second loop sized and shaped to extend across the chest, over the shoulder of the arm opposite the racket holding arm and across the back of the body of a trainee; said first loop being sized and shaped to extend around the shoulder of said racket holding arm of a trainee and said second loop being attached at its ends to said first loop at opposite points thereon; a cord extending from said first loop towards said racket, an attachment means on one end of said cord to secure said cord to a tennis racket at a point intermediate the portion of a head engaging a ball and the portion of the handle grasped by a trainee.

2. The tennis training device of claim 1 further characterized in that said cord is substantially non-elastic and of a length to prevent the head of a tennis racquet when stroking same from being located below a wrist of the trainee.

3. The game training device of claim 1 further characterized in that said attachment means comprises a clamp member.

4. The tennis training device of claim 1 further characterized in that said first and second loops are each provided with their own individual adjustment means to adjust the sizes of the first and second loops to conform to the size of a trainee.

5. The tennis training device of claim 1 further characterized in that a portion of said cord is comprised of a first section which is somewhat resilient but yet substantially inelastic and inextensible, a second section which is slightly elastic and slightly extensible to permit movement of a tennis racquet, and adjustment means is associated with said cord to adjust the overall length thereof.

6. The tennis training device of claim 1 further characterized in that the attachment means is a manually operable clamp attachment means which removably secures the cord to a tennis racquet.

7. The tennis training device of claim 1 further characterized in that said cord has a length of such size to permit a trainee to swing at a ball without locating the head of a tennis racquet below the point of grasping of the handle by a trainee.

8. The training device of claim 1 further characterized in that said cord is adapted for attachment to a racquet at the point where the handle connects to the head.

9. The training device of claim 1 further characterized in that said cord is adapted for attachment to the head of a racquet.

10. A tennis training device for assisting a trainee in stroking a tennis racquet having a head capable of engaging a ball and a handle capable of being grasped by a trainee; said training device comprising: a harness adapted to be secured to the body of a trainee, said harness comprising only first and second body loops, said second loop extendable across the chest, over the shoulder of the arm opposite the racket holding arm and across the back of the body of a trainee; said first loop being extendable around the shoulder of said racket holding arm of a trainee and said second loop being attached at its ends to said first loop at opposite points thereon; a cord extending from said first loop towards said racket, and attachment means on one end of said cord to secure the cord to a tennis racket at a point intermediate the portion of a head engaging a ball and the portion of the handle grasped by the trainee, said cord being substantially non-elastic and of a length to prevent the head of a tennis racket when stroking same from being located below the wrist of a trainee.

11. The tennis training device of claim 10 further characterized in that said attachment means is a clamp member.

* * * * *